US006332564B2

(12) United States Patent
Ichikawa

(10) Patent No.: US 6,332,564 B2
(45) Date of Patent: Dec. 25, 2001

(54) LIQUID CONTAINER

(75) Inventor: Tooru Ichikawa, Misato (JP)

(73) Assignee: Hosokawa Yoko Co., Ltd. (JP)

( * ) Notice: Subject to any disclaimer, the term of this patent is extended or adjusted under 35 U.S.C. 154(b) by 0 days.

(21) Appl. No.: 09/392,790

(22) Filed: Sep. 9, 1999

(30) Foreign Application Priority Data

Apr. 27, 1999 (JP) ..... 11-120555

(51) Int. Cl.[7] ..... B67D 5/60

(52) U.S. Cl. ..... 222/464.1; 222/464.3; 222/526; 222/527; 222/533; 383/904; 383/906

(58) Field of Search ..... 222/107, 464.1, 222/464.3, 464.4, 526, 527, 533; 383/105, 904, 906; 215/387, 388, 389; 220/705, 707, 709, 717

(56) References Cited

U.S. PATENT DOCUMENTS 3,645,424 * 2/1972 Gunning ..... 222/464.1 X
4,703,892 * 11/1987 Nadel ..... 222/533 X
4,718,778 * 1/1988 Ichikawa ..... 383/100
4,830,235 * 5/1989 Miller ..... 222/464.4
5,522,548 * 6/1996 Gallien et al. ..... 222/464.3 X
5,647,511 * 7/1997 Bond ..... 222/464.3 X
5,678,732 * 10/1997 Gianpaolo ..... 222/107
5,699,936 * 12/1997 Sakamoto ..... 222/107
5,797,522 * 8/1998 Evans et al. ..... 222/464.4

FOREIGN PATENT DOCUMENTS

2031526 * 4/1980 (GB) ..... 222/464.4 X

* cited by examiner

*Primary Examiner*—Kevin Shaver
*Assistant Examiner*—Frederick Nicolas
(74) *Attorney, Agent, or Firm*—Parkhurst & Wendel, L.L.P.

(57) ABSTRACT

A liquid container comprises a bag-shaped container body formed of a flexible film and a delivery unit having a mouth portion, a joining portion and a shank portion, the joining portion being secured to an opened end portion of the bag-shaped container body, the mouth portion extending outward of the bag-shaped container body from the joining portion and the shank portion extending inside the bag-shaped container body from the joining portion. The joining portion and the shank portion of the delivery unit are connected to be relatively rotatable with each other by an engaging member such as pin-and-hole connection or other flexible member such as bellows.

14 Claims, 8 Drawing Sheets

LIQUID CONTAINER

BACKGROUND OF THE INVENTION

1. Field of the Invention

The present invention relates to a liquid container comprising a bag-shaped container body and a delivery unit for taking out an inner content filling the bag-shaped container body.

2. Description of the Related Art

There are known liquid containing to be filled with orange juice or another fluid as shown in FIG. 9, and the shown liquid container 101 comprises a bag-shaped container body 102 formed of a flexible film and having an upper opening portion and a delivery unit 106 having a mouth portion 103, a joining portion 104 and a conduit portion (shank portion) 105 as a shank portion, in which the joining portion 104 of the delivery unit 106 is secured to an opened end 102*a* of the bag-shaped container body 102.

In the liquid container 101 mentioned above, since the mouth portion 103, the joining portion 104 and the conduit portion 105 of the delivery unit 106 are formed unitedly with each other, the mouth portion 103 of the delivery unit 106 extends perpendicularly outward over the upper end of the bag-shaped container body in a state that the joining portion 104 of the delivery unit 106 is secured to the opened end 102*a* of the bag-shaped container body 102 having the upper opening.

In the liquid container mentioned above, since the mouth portion 103 of the delivery unit 106 straightly extends from the joining portion 104, the container filled up with the inner content maintains a state that the mouth portion 103 extends perpendicularly outward over the upper end of the bag-shaped container body 102. For this structure, in a case where a plurality of such liquid containers filled up with the inner liquid content are packaged and conveyed to an aimed place(destination) in a state that the liquid containers are vertically piled up with each other in a corrugated board container box, it is required that each of the vertically piled-up liquid containers occupies a vertical space corresponding to a total height summing up a height of the container body and an extending length of the mouth portion of the delivery unit. In such piled arrangement of the liquid containers, the space corresponding to a height of the extending length of the mouth portion cannot not be effectively utilized, thus being defective for the packaging or loading efficiency and, hence, being not economical.

Moreover, the conduit(shank) portion 105 of the delivery unit 106 extends straightly vertically in the container body 102 in the state that the liquid container 101 is in a usual vertical position, and accordingly, when the delivery unit 106 is rotated and tilted so that the delivery unit 106 takes its horizontal attitude with respect to the container body 102, the free end portion (a distal front end) of the conduit portion 105 abuts against the inner surface of the container body even at a small rotating angle. It is therefore difficult to rotate the delivery unit at a large rotating angle, and hence, such liquid container is not effectively usable as a liquid container to be used for a person who lies on a bed, for example.

Furthermore, when it is required for a person to drink the inner content filling the container bag while maintaining the horizontal state of both the container body 102 and the delivery unit 106 of the liquid container 101, the mouth portion 103 and the conduit portion 105 are positioned on the same straight level as that of the joining portion 104 and, hence, the lower portion of the container body 102 swells downward because of the inner liquid content. Accordingly, the axial line of the delivery unit 106 becomes parallel to the surface level of the inner liquid content, so that when a person such as patient lying on a bed wants to drink the inner liquid with a weak mouth closing force, there may be that an undesired large amount of the liquid flowing out from the container body and, in an adverse case, the liquid may flow into a bronchus of the patient.

Furthermore, there has been known in the prior art a liquid container 201, such as shown in FIG. 10, which comprises a bag-shaped container body 202 and a delivery unit 206 having a mouth portion 203 and a joining portion 204 and having no conduit (shank) portion, in which the joining portion 204 is secured to an opened end portion 202*a* of the container body 202.

The delivery unit 206 of such liquid container 201 can be rotated at a large angle because of no conduit portion extends in the container body. However, when the delivery unit 206 is rotated and tilted with respect to the container body 202, an inner opened end portion of the delivery unit 206 positioned inside the container body 202 may contact the inner surface of the container body 202 and may be closed by the inner surface of the container body 202. Moreover, when an inner liquid content 207 is reduced, inner surfaces, constituting front and back surfaces (walls), of the container body 202 may cling to each other. Therefore, it is also difficult to use such liquid container for a person lying on a bed, for example.

SUMMARY OF THE INVENTION

An object of the present invention is to substantially eliminate defects or drawbacks encountered in the prior art mentioned above and to provide a liquid container having a delivery unit having a portion bendable in a horizontal direction to reduce the entire vertical height of the liquid container thereby eliminating an extra space when piled in a corrugated board box, for example.

Another object of the present invention is to provide a liquid container with a delivery unit having a portion bendable in a horizontal direction so that even a person lying on a bed can easily drink the liquid stored in the liquid container.

These and other objects can be achieved according to the present invention by providing a liquid container comprising:

a bag-shaped container body formed of a flexible film and having an opened end portion; and a delivery unit having a mouth portion, a joining portion and a shank portion, the joining portion being secured to the opened end portion of the bag-shaped container body, the mouth portion extending outward of the bag-shaped container body from the joining portion and the shank portion extending inside the bag-shaped container body from the joining portion, the joining portion and the shank portion of the delivery unit being connected to be relatively rotatable with each other.

The shank portion may be a tubular conduit portion having a throughout passage which is communicated with a throughout passage formed to said mouth portion and said joining portion.

In preferred embodiments, the joining portion and the shank portion of the delivery unit are pivotally connected by engaging means.

The engaging means may be composed of a pin member provided for either one of the shank portion and the joining portion and a hole formed to another one of the shank portion and the joining portion, the pin member being fitted into the hole. In an alternation, the pin member is unitedly formed to either one of the shank portion and the joining portion.

The shank portion and the joining portion of the delivery unit may be connected by a flexible bellows portion.

There may be a case where the joining portion and the shank portion are connected so as to maintain the shank portion at at least a predetermined rotated angle position with respect to the joining portion.

In such an embodiment, the liquid container may further comprise means for maintaining the shank portion at at least a predetermined rotated angle position with respect to the joining portion. When the joining portion and the shank portion of the delivery unit are pivotally connected by engaging means, the engaging means may constitute the rotated angle position maintaining means with a fitting resistance holding the shank portion at an optional rotated angle position with respect to the joining portion.

In the above aspect, the engaging means may be composed of a pin member provided for either one of the shank portion and the joining portion and a hole formed to another one of the shank portion and the joining portion, the pin member being fitted into the hole, and in an alternation, the pin member is unitedly formed to either one of the shank portion and the joining portion. The engaging means may be formed with a bellows portion through which the shank portion and the joining portion of the delivery unit are connected while maintaining an optional rotated angle position of the shank portion with respect to the joining portion.

There may be a case where the shank portion and the joining portion of the delivery unit are connected by a flexible bellows portion while maintaining an optional rotated angle position of the shank portion with respect to the joining portion.

The shank portion may have a free end portion, apart from the joining portion, which is tapered finely.

Furthermore, an opening may be formed at a portion between the shank portion and the joining portion.

The nature and further characteristic features of the present invention will be made more clear from the following descriptions with reference to the accompanying drawings.

DETAILED DESCRIPTION OF THE PREFERRED EMBODIMENT

A preferred embodiment of the present invention will be described hereunder with reference to the accompanying drawings.

Figure 1:
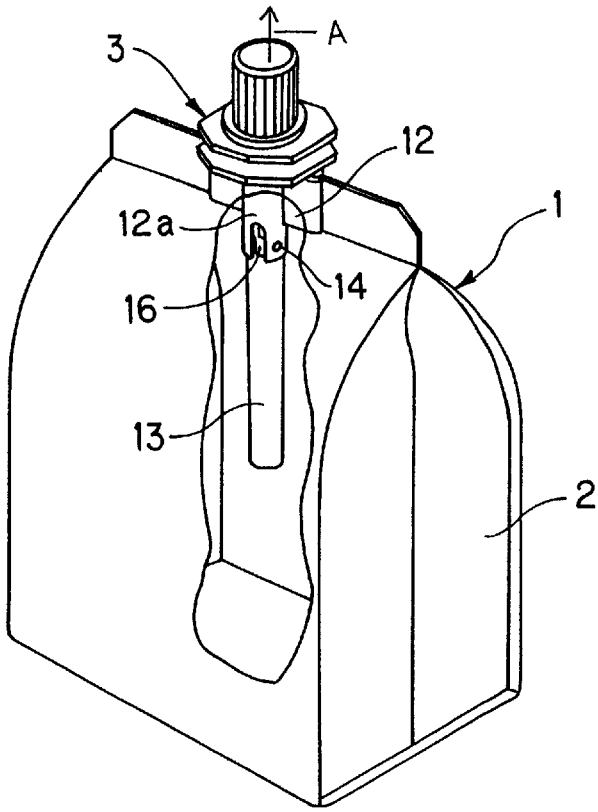
FIG. 1 is a perspective view of a liquid container, partially broken away, according to one embodiment of the present invention.

First, with reference to FIG. 1, a liquid container according to the present invention is totally designated by a reference numeral 1, and the liquid container 1 comprises a bag-shaped container body 2 having an upper end opening and a delivery unit 3 secured to the opened end portion of the container body 2.

The bag-shaped container body 2 is composed, for example, as shown in FIG. 1, two flat portions constituting front and back wall sections and two gusset portions which are folded inward and constitute side wall sections of the container body.

Figure 2:
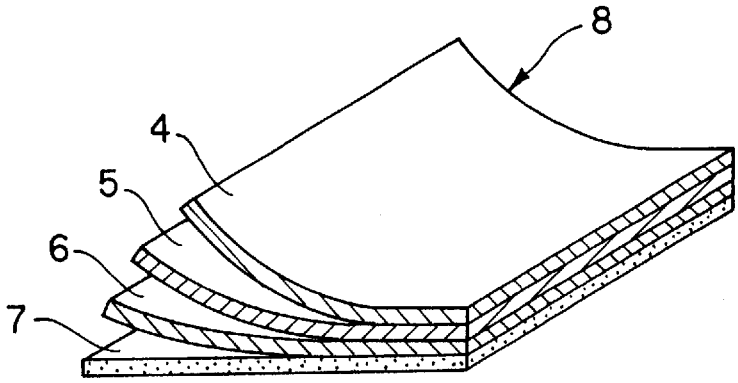
FIG. 2 is a perspective view of a lamination film forming a bag-shaped container body of the liquid container of the present invention.

The bag-shaped container body 2 has a flexible structure, which is composed of a film material such as a laminate film material 8, as shown in FIG. 2, comprising a polyester film 4 having a thickness of 12 $\mu$m, an aluminum foil 5 having a thickness of 9 $\mu$m, an oriented nylon film 6 having a thickness of 15 $\mu$m and a polyethylene film 7 having a thickness of 60–120 $\mu$m. It is however noted that the above mentioned laminate film material 8 is one preferred example and another laminate film or a single-layered film may be selectively utilized as far as it has a flexible structure.

Figure 3:
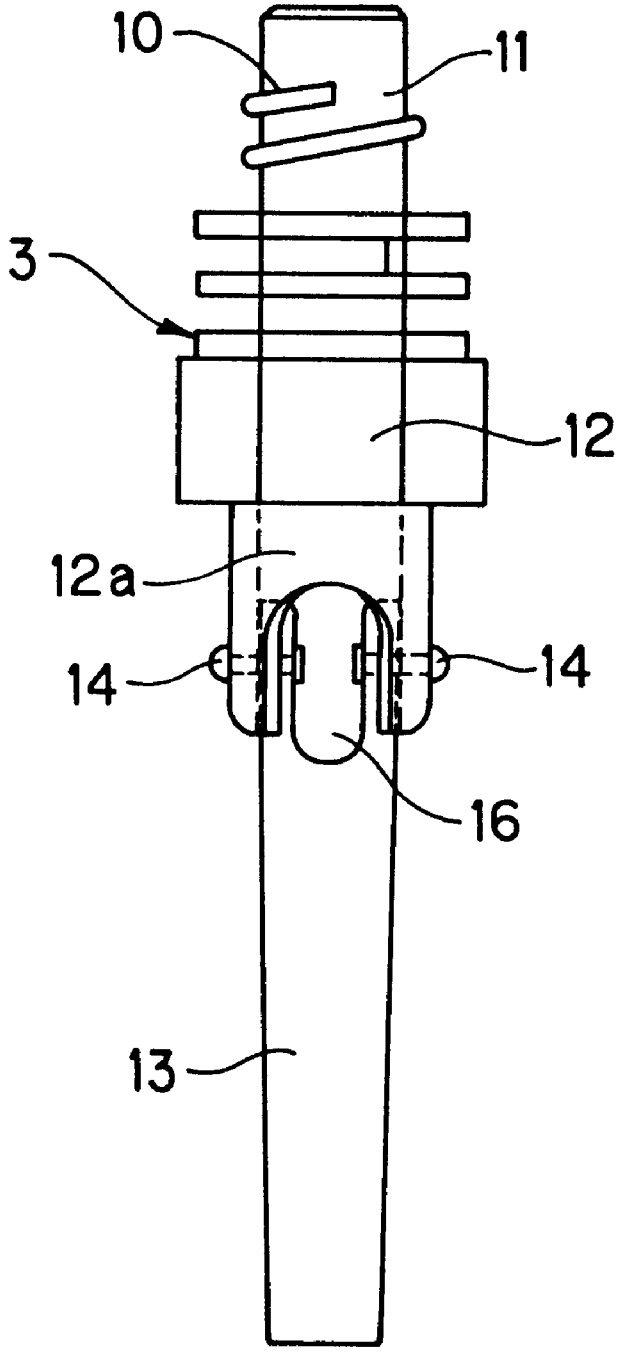
FIG. 3 is a front view of a delivery unit of the liquid container of the present invention.
Figure 4:
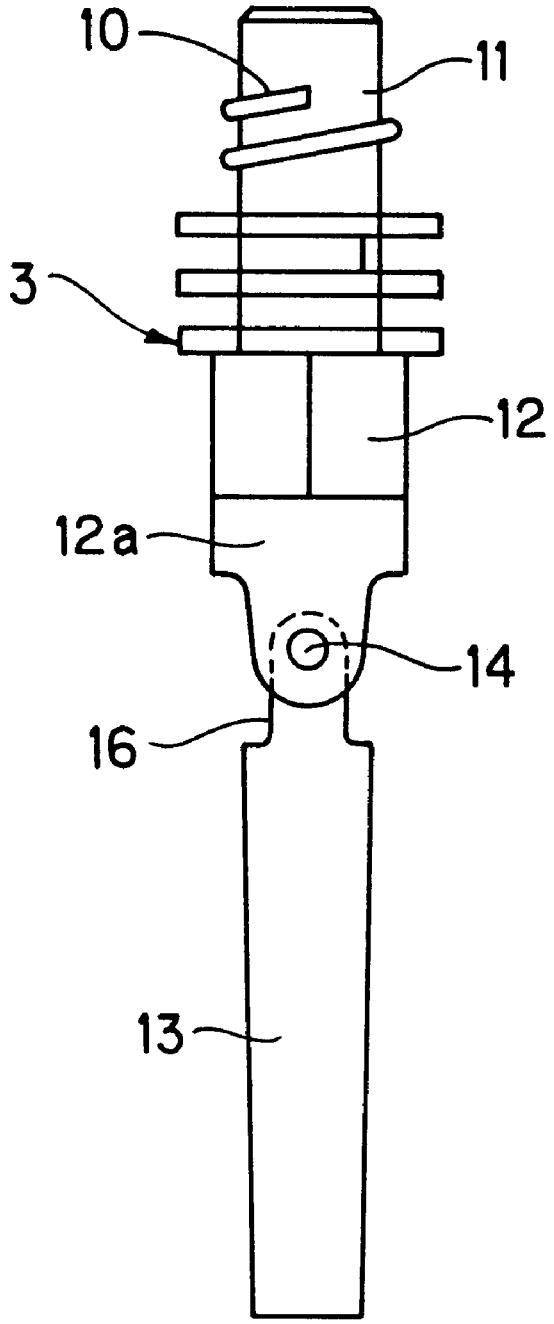
FIG. 4 is a side view of a delivery unit of the liquid container of the present invention.

As shown in FIGS. 3 and 4, the delivery unit 3 is composed of a mouth portion 11, a joining portion 12 and a conduit (shank) portion 13, which are operatively connected continuously. The mouth portion 11 has an outer surface to which a screw thread portion 10 is formed. The joining portion 12 is unitedly connected to the lower end portion of the mouth portion 11 and has a joining surface and a support portion 12*a* extending downward from the lower end portion of the joining surface. The conduit portion 13, as a shank portion, is pivotally connected to the support portion 12*a* of the joining portion 12. Pins 14, 14 are applied to the upper portion of the conduit portion 13 so as to be fitted to fitting holes 15, 15 formed to the support portion 12*a* of the joining portion 12.

Accordingly, in the delivery unit 3, the conduit portion 13 is pivotal with respect to the joining portion through the engagement of the pins 14, 14 with the fitting holes 15, 15 formed to the support portion 12*a* of the joining portion 12.

In a modified example, there may be adapted a structure in which pins are formed to the support portion 12*a* so as to extend in a radially inward direction thereof and fitting holes are formed to the upper portion of the conduit portion 13 so that the pins are fitted to the holes.

In another modified example, a molded form of the mouth portion and the joining portion, a molded form of the conduit portion and a pin, which are separately prepared, may be utilized, in which the pin is fitted into and through a fitting hole formed to the support portion 12*a* of the joining portion and a fitting hole formed to the upper portion of the conduit portion 13. According to this structure, the conduit portion 13 will be pivotally connected to the joining portion 12.

An opening 16 is formed between the joining portion 12 and the conduit portion 13 at their connected portion, and the opening portion 16 acts as a liquid guiding port by reversing (up-side-down) the attitude of the liquid container 1, thus taking out almost all amount of the liquid content in the container body from the mouth portion 11 through the opening 16.

The delivery unit 3 of the structure mentioned above is set such that a fitting resistance between the conduit portion 13 and the support portion 12*a* of the joining portion 12 is 200 g or more so as to suitably maintain the rotational angle of the conduit portion 13 with respect to the support portion 12*a*. That is, this fitting resistance is predetermined to an extent that the rotational angle position of the conduit portion 13 with respect to the support portion 12*a* is not displaced or shifted by the weight of the liquid content filling the container body. This fitting resistance will be determined by the material forming the delivery unit 3 and the difference between the outer diameter of the pin 14 and the inner diameter of the hole 15.

The conduit portion 13 has a convergent structure towards its front free end, and while the rotational angle of the conduit portion 13 is maintained with respect to the support portion 12*a* of the joining portion 12, the outer peripheral surface of the converged front end of the conduit portion 13 is in contact with the inner surface of the container body 2 so that the opened end surface of the lower portion of the conduit portion 13 does not come contact with the inner surface of the container body 2 thereby preventing the inner surface of the container body 2 from being damaged by the rotating conduit portion 13 and to keeping the opened end area thereof.

The liquid container of the present invention having the structure mentioned above will operate as follows.

When a vacant liquid container 1 is filled with the inner liquid content, the mouth portion 11 of the delivery unit 3 of the liquid container 1 filled up with the inner content may still maintain its vertically upward extending state from the container body 2 as like as a conventional liquid container of this kind.

Figure 5:
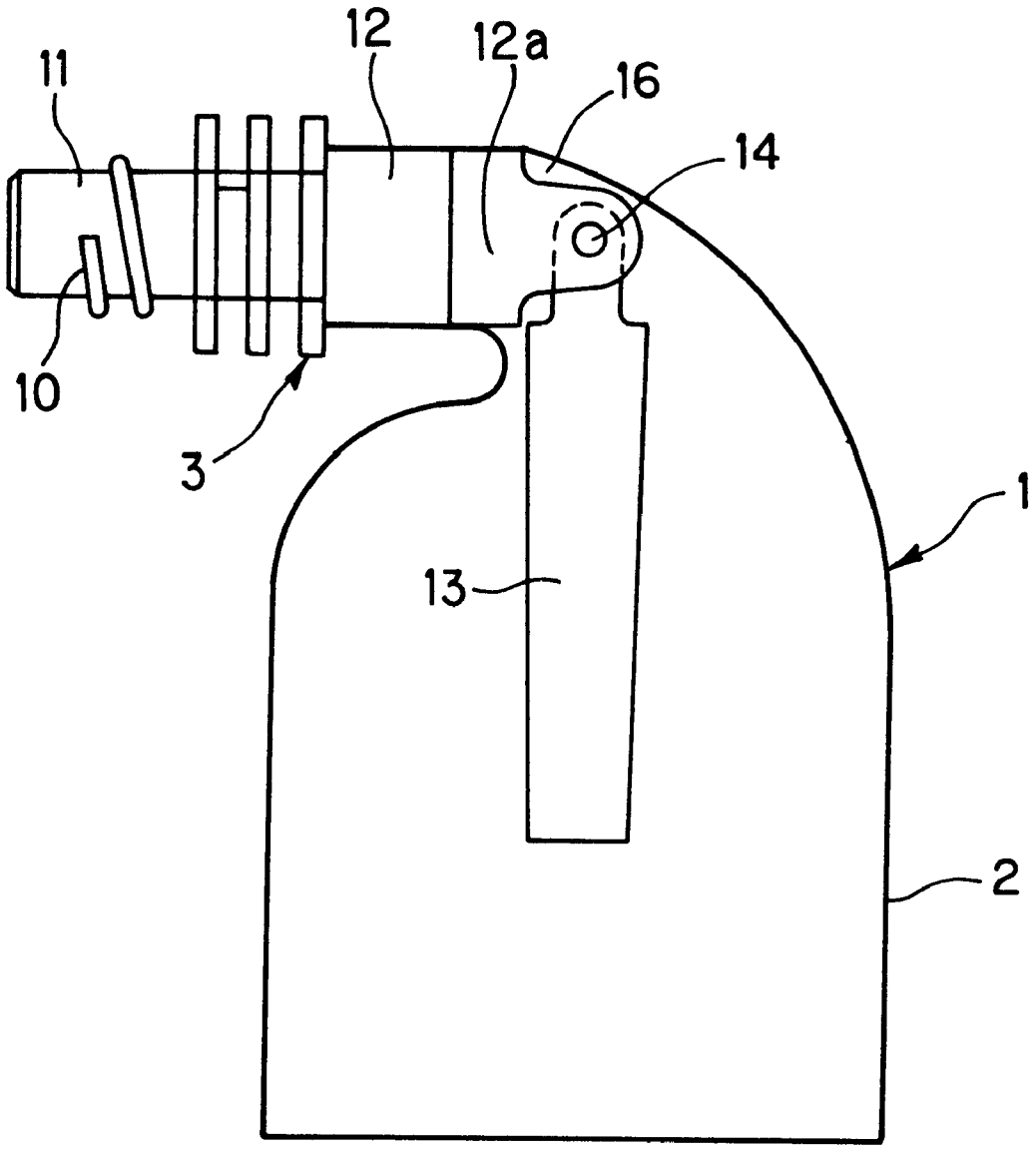
FIG. 5 is an illustrated side view showing a using state of the liquid container of the present invention.

According to the liquid container 1 of the present invention, after being filled up with the inner content, as shown in FIG. 5, a portion above the joining portion 12 of the delivery unit 3 can be bent to take the horizontal position by rotating that portion by 90° about the pin connecting portion. In this operation, the portion of the delivery unit 3 above the joining portion 12 can maintain its horizontal position by making tight the fitting of the pins 14, 14 of the conduit portion 13 to the holes 15, 15 formed to the lower end portion 12*a* of the joining portion 12.

The liquid containers 1, each having the portion of the delivery unit 3 above the joining portion 12 which is bent horizontally as shown in FIG. 5, are piled and accommodated vertically in rows in a corrugated board box, not shown. In such piling operation, since the portions of the delivery units 3 of the liquid containers 1 filled up with the inner liquid contents are bent horizontally in the state accommodated in the corrugated board box, the total height of the piled liquid containers 1 can be reduced in dimension in comparison with a conventional accommodated state of the liquid containers of this kind, thus eliminating the space loss and hence enhancing the piling or loading efficiency.

When it is required to take out the inner liquid content from the liquid container 1, a person, who wants to drink the liquid content, will grasp the conduit portion 13 of the delivery unit 3 from the outside portion of the container body 2 and applies a horizontal force to the mouth portion 11 of the delivery unit 11 to rotate that portion to a suitable angle to drink the liquid content.

In this operation, since the conduit portion 13 and the joining portion 12 of the delivery unit 3 are connected to be pivotal, when the horizontal force is applied to the mouth portion 11 of the delivery unit 3, the mouth portion 11 and the joining portion 12 rotate with respect to the conduit portion 13 to the position, shown in FIG. 5, for example, suitable for drinking and maintain such rotated position. This rotated position of the mouth portion 11 and the joining portion 12 of the delivery unit 3 can be maintained by setting the fitting resistance between the support portion 12*a* of the joining portion 12 and the conduit portion 13 to a predetermined set value. As mentioned above, by maintaining the mouth portion 11 to the predetermined set angle position with respect to the conduit portion 13, the mouth portion 11 of the liquid container 1 is properly straightly directed to a person such as child, baby or patient, and hence, the person can easily drink the liquid contained in the liquid container 1 without taking any undesired drinking position or attitude.

Figure 6:
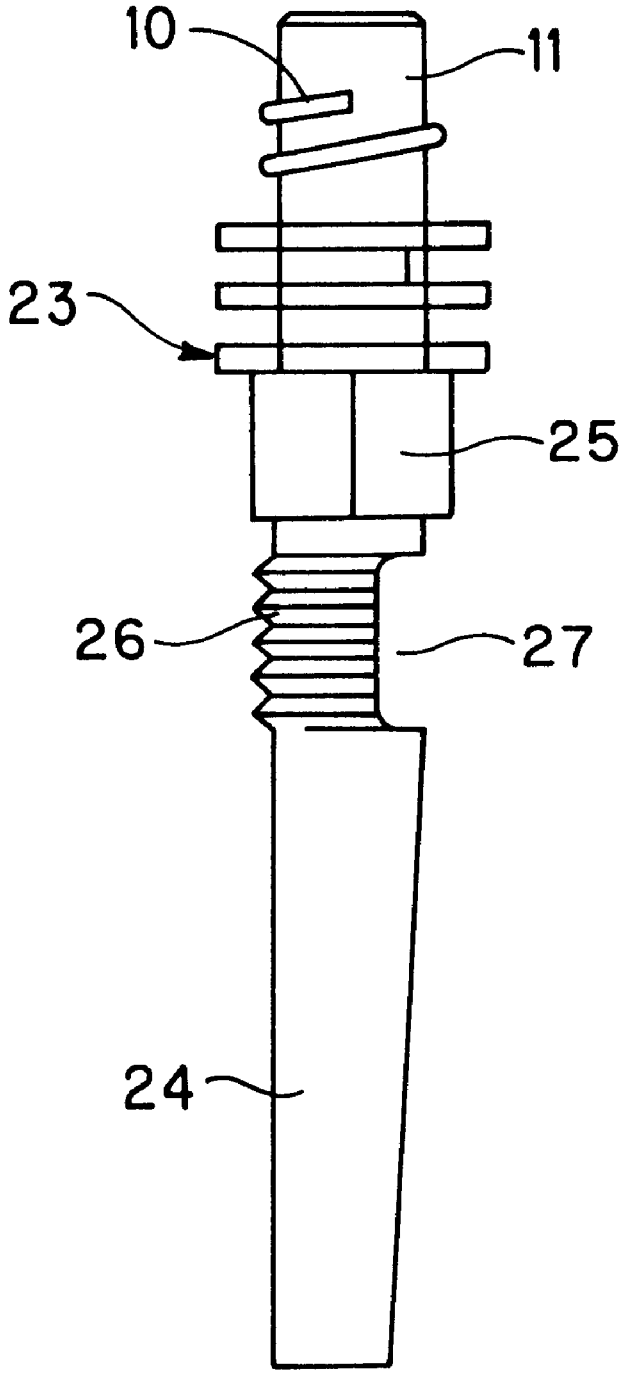
FIG. 6 is a view showing a modified example of the delivery unit of the liquid container of the present invention.
Figure 7:
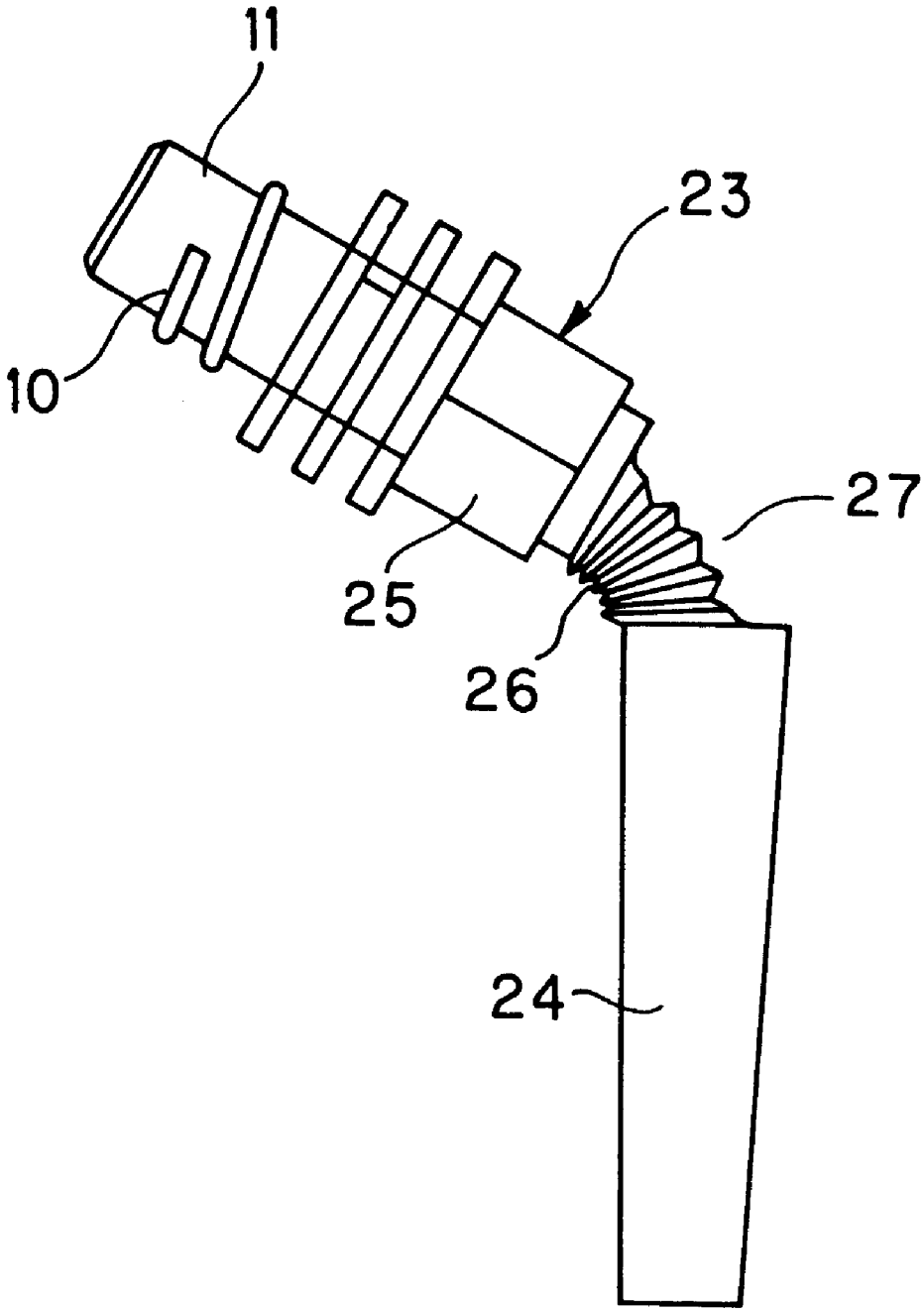
FIG. 7 is an illustrated side view showing the operative state of the delivery unit of FIG. 6.

FIGS. 6 and 7 represent another embodiment of the present invention, in which a bellows portion 26 is formed to a portion between a conduit (shank) portion 24 and a joining portion 25 of a delivery unit 23 so that a portion of the delivery unit 23 above the joining portion 25 is rotatable about the bellows portion 26. In this structure, an opening 27 may be formed to the bellows portion 26.

In this embodiment, since the conduit portion 24 and the joining portion 25 are connected through the bellows portion 26, they can be rotated or tilted to an optional or posable to place in a particular position angular position and maintain such rotated position as in the former embodiment in which the pin connection means is utilized.

Further, in an alternation of this embodiment, the bellows portion 26 may be endowed with an elastic or flexible property so that the bellows portion 26 can be rotated by an external force and is returned to its original position before rotation when the bellows portion 26 is released from the external force.

Figure 8:
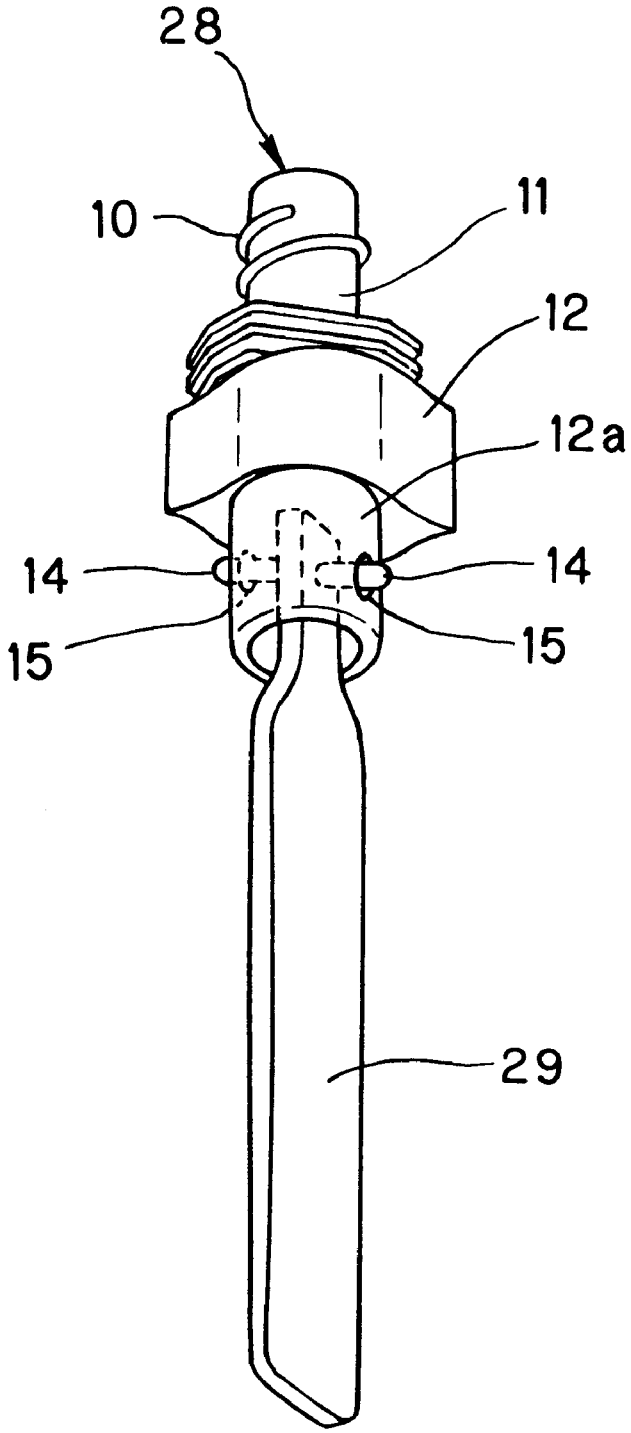
FIG. 8 is a perspective view of another modified example of the delivery unit of the liquid container of the present invention.
Figure 9:
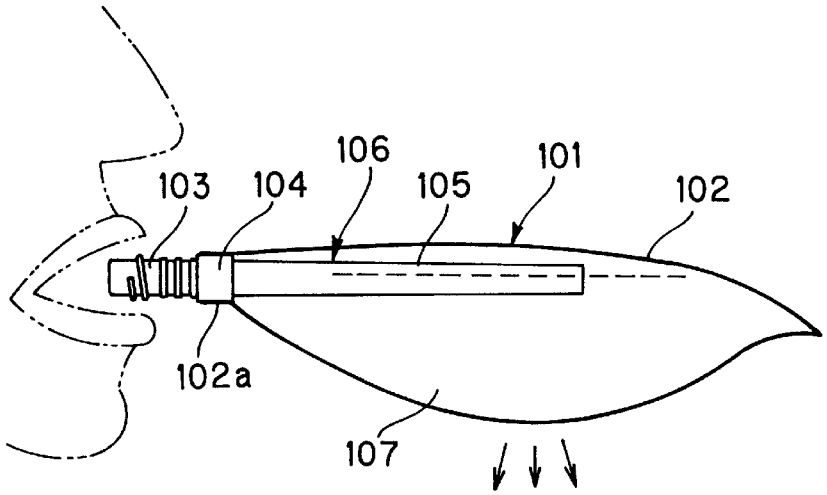
FIG. 9 PRIOR ART
FIG. 9 is an illustration of one example of a conventional liquid container in a using state.
Figure 10:
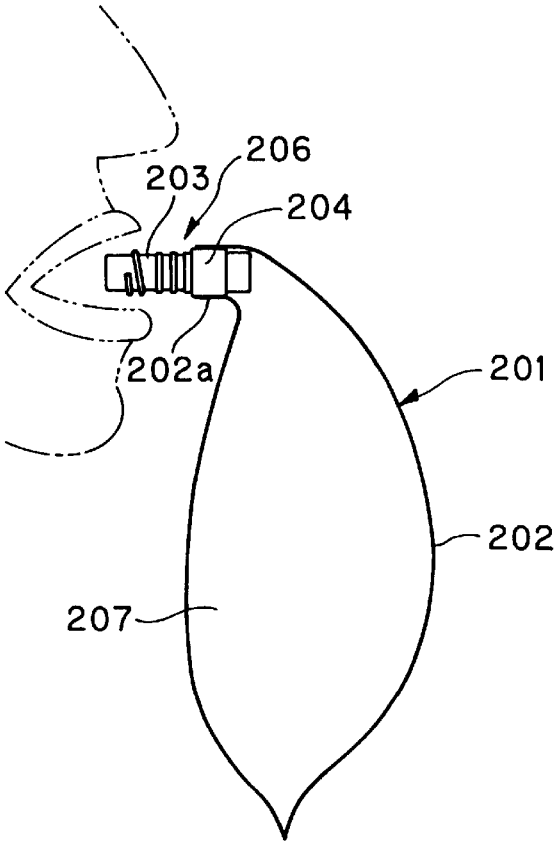
FIG. 10 PRIOR ART
FIG. 10 is an illustration of another example of a conventional liquid container in a using state.

FIG. 8 shows a further embodiment of the present invention. In this embodiment, the conduit portion in the former embodiment is formed as a shank portion. That is, a delivery unit 28 is basically composed, as shown in FIG. 8, of the mouth portion 11, the joining portion 12 and a shank portion 29, which are operatively connected. The mouth portion 11 has an outer surface to which a screw thread portion 10 is formed. The joining portion 12 is unitedly connected to the lower end portion of the mouth portion 11 and has a joining surface and a support portion 12*a* extending downward from the joining portion 12. The shank portion 29 has a solid structure having no inner passage and is pivotally connected to the support portion 12*a* of the joining portion 12. Pins 14, 14 are formed to the upper portion, as viewed, of the shank portion 29 so as to extend sideways therefrom and to be fitted to fitting holes 15, 15 formed to the support portion 12*a* of the joining portion 12.

According to the structure of this embodiment, in the delivery unit 28, the shank portion 29 is made pivotal with respect to the joining portion 12 through the engagement of the pins 14, 14 with the fitting holes 15, 15 formed to the support portion 12*a* of the joining portion 12.

In the present invention, as mentioned above, the portion extending inside the bag body from the joining portion 12 can be formed as the conduit (tubular shank) 13, as shown in FIG. 3, having the throughout passage communicated with that formed to the mouth portion 11 and the joining portion 12 of the delivery unit 3 or formed as the shank portion 29 of the delivery unit 28, as shown in FIG. 8, having an elongated solid structure such as flat plate shape or rod shape having no inner liquid passage.

As mentioned above, according to the liquid containers of the present invention, the shank portion and the joining portion of the delivery unit secured to the opened end portion of the container body made of a flexible film material are connected to be rotatable with each other. Therefore, when such liquid containers are accommodated in a corrugated board box in the vertically piled state, the upper portions of the delivery units above the joining portions are rotated or tiled to take the horizontally bent positions, so that the piled height in the corrugated board box can be reduced in comparison with a conventional accommodated state, thus improving the loading efficiency.

Furthermore, since the mouth portion of the delivery unit can be bent to a desired angular position, even a person who lies on a bed can easily drink the inner liquid content.

What is claimed is:

1. A liquid container comprising:

a bag-shaped container body formed of a flexible film and having an open end portion extending in a longitudinal direction of the liquid container; and a delivery unit passing through the open end portion and extending from the outside of the body to the inside thereof, the delivery unit including (1) a mouth portion including a first opening and provided with an axially extending passage disposed outside of and extending from the open end portion of the body in the longitudinal direction thereof, (2) a joining portion inside the body attached to the mouth portion, the joining portion defining a second opening, thereby allowing any contents in the body to pass directly into the second opening of the joining portion, and through the joining portion and the mouth portion, and (3) a shank portion pivotally joined to the joining portion at the end opposite to the mouth portion, wherein the shank pivots in response to deformation of the open end portion of the body with rotation of the mouth portion and the joining portion.

2. A liquid container according to claim 1, wherein said shank portion is a tubular conduit portion having an axial passage attached to the joining portion which communicates with the first and second openings of said mouth portion and said joining portion, respectively, whereby the contents of the bag have at least two pathways for leaving the bag, a bag/joining/mouth pathway and a bag/shank/joining/mouth pathway, thereby ensuring that the contents leave the bag despite the flexible film obstructing one pathway.

3. A liquid container according to claim 1, further comprising a pin member, and a hole defined by the shank portion and the joining portion, into which the pin member is fitted, for pivotally joining the shank portion and the joining portion.

4. A liquid container according to claim 1, wherein said shank portion and said joining portion of the delivery unit are pivotally connected by a flexible bellows portion.

5. A liquid container according to claim 1, wherein said joining portion and said shank portion are connected so as to maintain the shank portion at least at a predetermined rotated angle position with respect to the joining portion.

6. A liquid container according to claim 1, wherein said shank portion has a free end portion apart from the joining portion, wherein said free and end portion is tapered.

7. A liquid container according to claim 1, further comprising a third opening at a portion between the shank portion and the joining portion.

8. A liquid container according to claim 1, wherein the liquid container is filled with a liquid.

9. A liquid container according to claim 3, wherein said pin member is unitedly formed to either one of the shank portion and the joining portion.

10. A liquid container according to claim 5, further comprising means for maintaining the shank portion at at least a predetermined rotated angle position with respect to the joining portion.

11. A liquid container according to claim 10, wherein said joining portion and said shank portion of the delivery unit are pivotally connected by engaging means, said engaging means constituting said rotated angle position maintaining means and having a fitting resistance to hold the shank portion at a posable rotated angle position with respect to the joining portion.

12. A liquid container according to claim 10, wherein said shank portion and said joining portion of the delivery unit are connected by a flexible bellows portion while maintaining a posable rotated angle position of the shank portion with respect to the joining portion.

13. A liquid container according to claim 11, wherein said engaging means is composed of a pin member provided for either one of the shank portion and the joining portion and a hole which is formed to another one of the shank portion and the joining portion and into which the pin member is fitted.

14. A liquid container according to claim 13, wherein said pin member is unitedly formed to either one of the shank portion and the joining portion.

* * * * *